US007984846B2

(12) United States Patent
Messerschmid et al.

(10) Patent No.: US 7,984,846 B2
(45) Date of Patent: Jul. 26, 2011

(54) PROCESS AND AN ARRANGEMENT FOR PRODUCING A CUP

(75) Inventors: Uwe Messerschmid, Albershausen (DE); Werner Stahlecker, Goeppingen (DE)

(73) Assignee: PTM Packaging Tools Machinery Pte., Singapore (SG)

( * ) Notice: Subject to any disclaimer, the term of this patent is extended or adjusted under 35 U.S.C. 154(b) by 775 days.

(21) Appl. No.: 11/879,217

(22) Filed: Jul. 16, 2007

(65) Prior Publication Data

US 2008/0029588 A1 Feb. 7, 2008

Related U.S. Application Data

(60) Provisional application No. 60/860,413, filed on Nov. 21, 2006.

(30) Foreign Application Priority Data

Jul. 17, 2006 (DE) ..... 10 2006 034 267
May 14, 2007 (DE) ..... 10 2007 024 254

(51) Int. Cl.
*B65D 3/14* (2006.01)
*B65D 3/22* (2006.01)

(52) U.S. Cl. ..... 229/400; 206/520; 229/403

(58) Field of Classification Search ..... 229/5.5, 229/400, 403; 206/505, 515, 519, 520; 220/633, 220/635; 215/10, 376, 377
See application file for complete search history.

(56) References Cited

U.S. PATENT DOCUMENTS 1,654,318 A * 12/1927 Benson ..... 229/5.6
1,968,270 A * 7/1934 Thiebaut ..... 229/5.5
2,563,352 A 8/1951 Morse
2,816,697 A 12/1957 Amberg
3,049,277 A 8/1962 Shappell
3,182,882 A * 5/1965 Aellen, Jr. et al. ..... 229/5.5
3,268,143 A * 8/1966 Bolcato ..... 229/400
3,325,048 A * 6/1967 Edwards ..... 206/520

(Continued)

FOREIGN PATENT DOCUMENTS

CH 563 889 7/1975

(Continued)

OTHER PUBLICATIONS

Office Action of State intellectual Property Office, P.R. China dated Jul. 24, 2009 (3 pages).

(Continued)

*Primary Examiner* — Gary E Elkins
(74) *Attorney, Agent, or Firm* — Flynn, Thiel, Boutell & Tanis, P.C.

(57) ABSTRACT

A process for producing a cup made of a paper material and comprising a fillable interior is described. A sleeve forming the interior is attached in an essentially liquid-tight manner to a wall of a pot-shaped bottom by means of the forming of a bottom skirt. In joining the sleeve to the bottom, two height areas of the wall of the pot-shaped bottom are provided. The wall of the pot-shaped bottom is joined only to a first height area of the sleeve, which is referred to as the fixed area of the bottom skirt. A second height area remains, in which the wall of the pot-shaped bottom is not attached to the sleeve, and which is referred to as the non-attached area of the bottom skirt. The bottom skirt can be widened subsequently in the non-attached area in at least one area along the periphery.

15 Claims, 9 Drawing Sheets

U.S. PATENT DOCUMENTS

| | | | | | |
|---|---|---|---|---|---|
| 3,437,253 | A | * | 4/1969 | McDonald et al. | 229/400 |
| 3,529,743 | A | | 9/1970 | Ehrbar et al. | |
| 3,568,878 | A | * | 3/1971 | Fotos | 206/520 |
| 3,854,583 | A | | 12/1974 | Amberg et al. | |
| 3,949,927 | A | * | 4/1976 | Smith et al. | 229/5.5 |
| 3,970,492 | A | | 7/1976 | Amberg et al. | |
| 3,995,740 | A | | 12/1976 | Amberg et al. | |
| 4,053,346 | A | | 10/1977 | Amberg et al. | |
| 4,088,526 | A | | 5/1978 | Amberg et al. | |
| 4,106,397 | A | | 8/1978 | Amberg et al. | |
| 4,117,971 | A | * | 10/1978 | Itoh | 229/400 |
| 4,197,948 | A | | 4/1980 | Amberg et al. | |
| 4,836,400 | A | | 6/1989 | Chaffey et al. | |
| 5,425,497 | A | * | 6/1995 | Sorensen | 229/403 |
| 6,364,201 | B1 | * | 4/2002 | Varano | 229/400 |
| 2004/0065424 | A1 | * | 4/2004 | Mohan et al. | 229/400 |
| 2006/0226210 | A1 | | 10/2006 | Stahlecker | |

FOREIGN PATENT DOCUMENTS

| | | | |
|---|---|---|---|
| DE | 961 053 | | 3/1957 |
| DE | 1 904 088 | | 9/1969 |
| DE | 31 15 689 | A1 | 1/1982 |
| DE | 297 06 961 | U1 | 9/1998 |
| DE | 10 2005 017 741 | A1 | 10/2006 |
| EP | 1 227 042 | B1 | 7/2002 |
| GB | 191206984 | | 1/1913 |
| GB | 558 436 | | 1/1944 |
| GB | 832 407 | | 4/1960 |
| GB | 2 420 267 | A | 5/2006 |
| JP | 55-134046 | | 10/1980 |
| JP | 08217051 | A | 8/1996 |
| JP | 2001 192015 | | 7/2001 |
| JP | 2003 340943 | | 2/2003 |
| JP | 2003 128038 | A | 5/2003 |
| JP | 2004-99079 | | 4/2004 |

OTHER PUBLICATIONS

Notification of Transmittal of International Search Report dated Sep. 26, 2007 (2 pages) for PCT/EP2007/006095.

International Search Report of PCT/EP2007/006095 (7 pages).

Written Opinion of International Searching Authority (7 pages) for PCT/EP2007/006095.

Notification of Transmittal of International Search Report dated Sep. 25, 2007 (2 pages) for PCT/EP2007/006094.

International Search Report of PCT/EP2007/006094 (5 pages).

Written Opinion of International Searching Authority (8 pages) for PCT/EP2007/006094.

German Patent Office Search Report dated Mar. 22, 2007 (4 pages).

Second Office Action of Chinese Patent Office dated Sep. 30, 2010 with English translation (9 pages).

* cited by examiner

PROCESS AND AN ARRANGEMENT FOR PRODUCING A CUP

CROSS REFERENCE TO RELATED APPLICATION

This application claims the benefit of U.S. Provisional Application No. 60/860 413, filed Nov. 21, 2006.

FIELD OF THE INVENTION

The present invention relates to a process for producing a cup made of paper material having a fillable interior, in which a sleeve forming the interior is attached in an essentially liquid-tight manner to a wall of a pot-shaped bottom by means of the forming of a bottom skirt.

The present invention also relates to an arrangement for producing a cup comprising at least one inner tool and one outer tool for forming a bottom skirt, and also a cup made of paper material produced in this way.

BACKGROUND OF THE INVENTION

A process of the above mentioned type and the corresponding arrangement are very often applied in the production of cups made of paper material. In the known process, the wall of a pot-shaped bottom is joined to a sleeve forming the interior in a liquid-tight manner along its entire height when the bottom skirt is formed. An inner tool used for pressing the sleeve and the bottom and also a corresponding outer tool both measure at least the height of the bottom skirt. The bottom skirt is as a result extremely stable and is very resistant to deforming.

In the case of cups made of paper material, the bottom skirt is a very important element of the cup. The bottom skirt is necessary for joining the sleeve and the bottom. At least two material layers are disposed in thickness direction on top of one another, namely the material of the bottom and the material of the interior-defining sleeve. The bottom is advantageously pot-shaped, the open side of said bottom facing away from the filling opening of the cup. The at least two material layers are advantageously arranged along the wall of the pot-shaped bottom. It can be additionally provided, for example, that the sleeve is folded inwards around the material of the bottom, and that the bottom skirt consists of three or more material layers. The material of the bottom is glued or sealed to the material of the sleeve in the area of the bottom skirt, in order that it is liquid-tight for at least a certain time.

The term "paper material", from which the bottom and the sleeve are made, includes various material, which comprise at least one layer of paper, paperboard or cardboard. In addition the material can comprise one or more layers made of synthetics and/or aluminium. It can also be provided that the paper material is waxed or coated, in order to provide a resistance against the liquid with which the cup is subsequently filled. The paper material is advantageously coated at least on the side facing the interior with a thin synthetic layer, preferably made of polyethylene. In contrast to purely synthetic material, the formability and in particular the ductibility of such paper material is limited. In the case of too great a deformation, the paper material itself, or a provided coating, may tear, so that the liquid-tight properties are impaired. The bottom skirt is therefore an essential design feature in the case of cups made of paper material and cannot be omitted.

If types of bottom skirt are required which are formed in a subsequent procedural step after the liquid-tight attachment of bottom and sleeve is formed, then the design possibilities of these forms are limited, as the bottom skirt is very resistant to the forming process. The area of the bottom skirt is barely flexible and it can easily occur that the material at the bottom skirt tears when the bottom skirt has to be subsequently re-shaped. It may easily occur that the liquid-tight attachment between sleeve and bottom is damaged, so that the cup is no longer liquid-tight when subsequently used.

It is an object of the present invention to create a bottom skirt which ensures a liquid-tight connection between sleeve and bottom even in the case of subsequent re-shaping of the bottom skirt.

This object has been achieved in accordance with the present invention in that when the sleeve and the bottom are joined to one another, two height areas of the bottom skirt are provided whereby the wall of the pot-shaped bottom is only joined to the sleeve in a first height area, which is referred to as the "fixed area" of the bottom skirt, and whereby a second height area remains, in which the wall of the pot-shaped bottom is not attached to the sleeve, and is referred to as the "non-attached area" of the bottom skirt.

The produced cup comprises on its bottom skirt at least one non-attached area, in which the sleeve and the bottom are not attached to one another in a liquid-tight manner.

The object of the present invention relating to the process has been achieved in that at least the inner tool or the outer tool has a height which is less than the height of the bottom skirt.

The provision of a fixed area and at least one non-attached area has the advantage in that subsequent to the production of the liquid-tight attachment in the fixed area of the bottom skirt, the bottom skirt can be further formed in subsequent procedural steps, without the liquid-tight attachment in the fixed area being impaired. Re-shaping of the bottom skirt can for example serve to change the design of the cup or to integrate additional functions into the bottom skirt. The bottom skirt is advantageously re-shaped in subsequent procedural steps in the non-attached area of the bottom skirt in such a way that the fixed area remains unchanged in its form and the liquid-tight connection is not impaired.

The non-attached area is advantageously arranged on the side of the bottom skirt facing away from the interior, so that the wall in the area of the open end of the pot-shaped bottom is not joined to the sleeve.

When the sleeve is joined to the bottom, the wall of the pot-shaped bottom is advantageously pressed in the fixed area with the sleeve in such a way that a pressing force is generated between the inner tool and the outer tool. The height of the inner tool and/or the outer tool is less than the height of the bottom skirt, which ensures that a height area of the bottom skirt, which subsequently forms the non-attached area, is not covered over either by the inner tool or by the outer tool. In order that the attachment in the fixed area remains liquid-tight, it can be provided that a glue is applied to the material of the sleeve and/or the bottom in the area of the wall, before the two parts are joined together and pressed. If the sides of the sleeve and the bottom in contact with the interior are provided with a thermoplastic synthetic coating, the sleeve can also be sealed with the bottom in the fixed area, whereby the sleeve and/or the bottom are warmed up and are subsequently pressed to one another only in the fixed area. Warming up to the point of melting of the synthetic coating can take place by means of a heated inner tool and/or an outer tool when the parts are pressed to one another, or by means of blowing hot air. The warming up extends hereby at least to the fixed area of the bottom skirt. The sleeve is advantageously warmed up in the area of the bottom skirt by means of blowing with hot air before the pot-shaped bottom is applied. After the bottom is applied to the sleeve, the material layers are pressed to one another in the fixed area, so that a liquid-tight sealing forms in this area.

In an advantageous embodiment of the present invention it can be provided that the bottom skirt is widened in the non-attached area at least in an area along the periphery. The lower edge of the widening can form a standing surface for the cup. The standing surface is increased by the widening, so that the cup cannot tip over so easily. When the bottom skirt is widened in the non-attached area, the material layers of the sleeve and of the bottom can slide against one another, as they are not attached to one another. The risk that the paper material, or a coating applied thereto, tears during forming of the widening is hereby greatly reduced. For the purposes of widening the bottom skirt, the arrangement for producing the cup can comprise at least one widening tool in a working station, which is arranged downstream of the first working station with the inner tool and the outer tool for forming the bottom skirt, which widening tool can be placed to the non-attached area. In addition a supporting tool can be provided, which can be placed to the fixed area of the bottom skirt during widening, and which prevents distortion in the shape. It can be provided that the bottom skirt is in addition warmed up in the non-attached area either before or during widening. If the widening at the bottom skirt is to be very stable, it can be provided in addition that the wall of the bottom is joined with the sleeve during or after the widening process, for example in that the non-attached area is warmed up to a temperature sufficient for sealing.

In a further advantageous embodiment, the widening at the bottom skirt forms a means for holding another cup of the same type. It can be hereby provided that a first holding means is formed on the sleeve defining the interior, which first holding means can act together with a second holding means on the bottom skirt. Furthermore, it can be advantageous that an outer sleeve is arranged to the cup, which serves to improve the insulating effect. The form of the outer sleeve is optional and is applied advantageously to the cup before the widening is formed in the non-attached area of the bottom skirt.

BRIEF DESCRIPTION OF THE DRAWINGS

These and further objects, features and advantages of the present invention will become more readily apparent from the following detailed description thereof when taken in conjunction with the accompanying drawings. Individual features of the various embodiments shown and described can be combined as required without exceeding the scope of the present invention.

DETAILED DESCRIPTION

Figure 1:
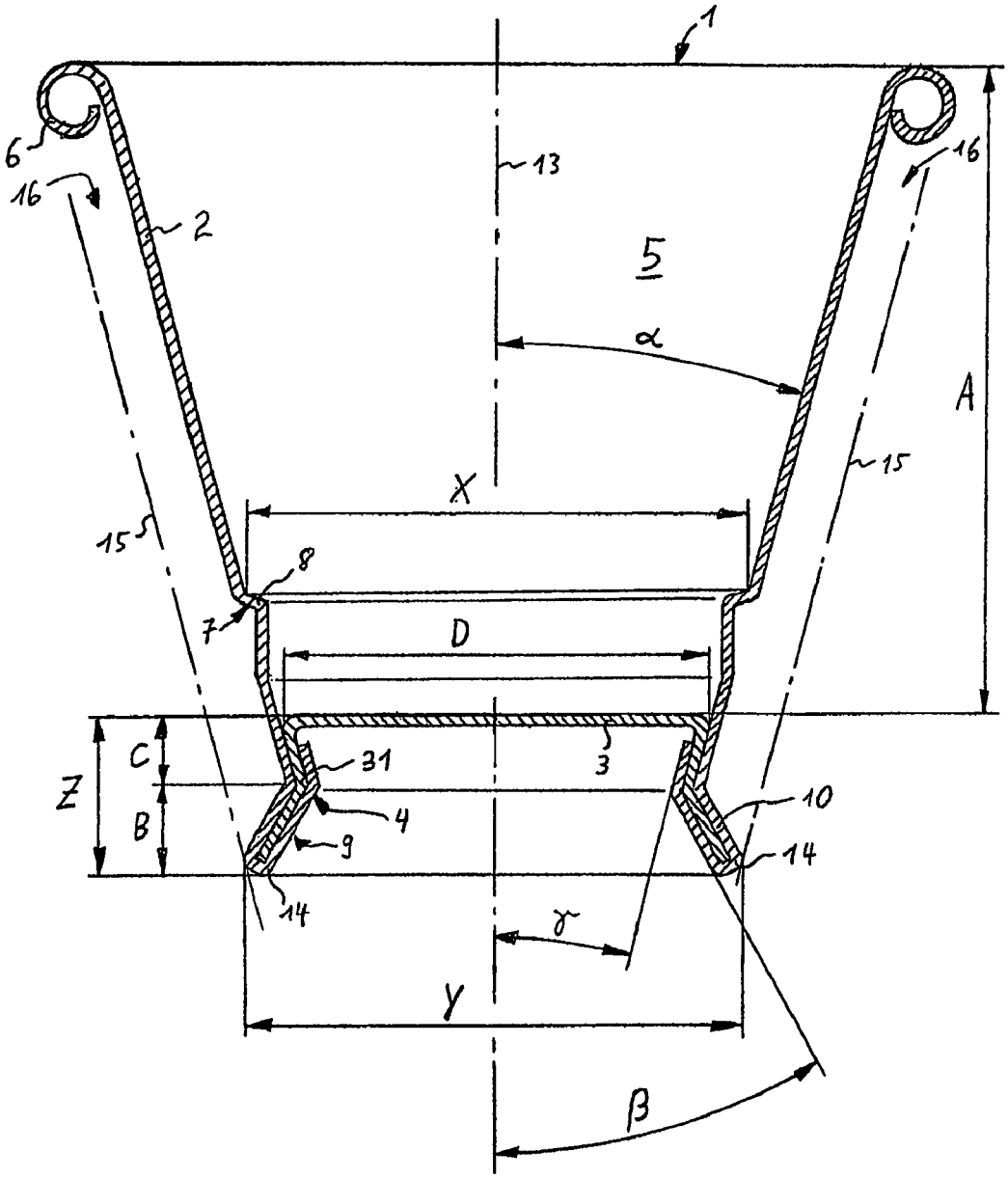
FIG. 1 shows a cup according to the present invention in longitudinal section.

The cup 1 shown in FIG. 1 consists essentially of a conical sleeve 2 and a pot-shaped bottom 3. The open side of the pot-shaped bottom 3 is arranged in such a way that it is facing away from the filling opening of the cup 1. The bottom 3 is attached liquid-tight with its wall 31 to the sleeve 2 in the area of its smallest diameter by means of a bottom skirt 4. In the area of the bottom skirt 4, the material of the sleeve 2 is placed around the wall 31 of the bottom 3 and folded inwards. The sleeve 2 and the bottom 3 form a fillable interior 5 of the cup 1. The fillable interior 5 has a height A. The sleeve 2 defining the interior 5 comprises on its top edge, that is, in the area of its largest circumference, an outwardly rolled lip 6, which surrounds the filling opening.

The conical feature of the sleeve 2 is hereby to be understood in that the sleeve 2 tapers in longitudinal section as shown in FIG. 1 from the lip 6 to the bottom 3. The sleeve 2 comprises hereby in the area of the fillable interior 5 an angle of inclination $\alpha$ to the middle axis 13 of the cup 1. The form of the sleeve 2 in cross section is hereby irrelevant. The sleeve 2 may be circular, oval or even rectangular with rounded edges in cross section. In the case of a round cross section of the conical sleeve 2, the cup 1 has a truncated cone shape, while in the case of a rectangular cross section, the conical sleeve 3 has a truncated pyramid shape.

The bottom skirt 4 comprises at least in the area along its periphery an outwardly projecting widening 10. A lower edge 14 of the widening 10 at the bottom skirt 4 forms a standing surface for the cup 1. The cup 1 stands on its standing surface during use, which standing surface is enlarged by the widening 10. This makes it difficult for the cup 1 to tip over. The widening 10 is advantageously designed continuously around the periphery of the bottom skirt 4.

Figure 2:
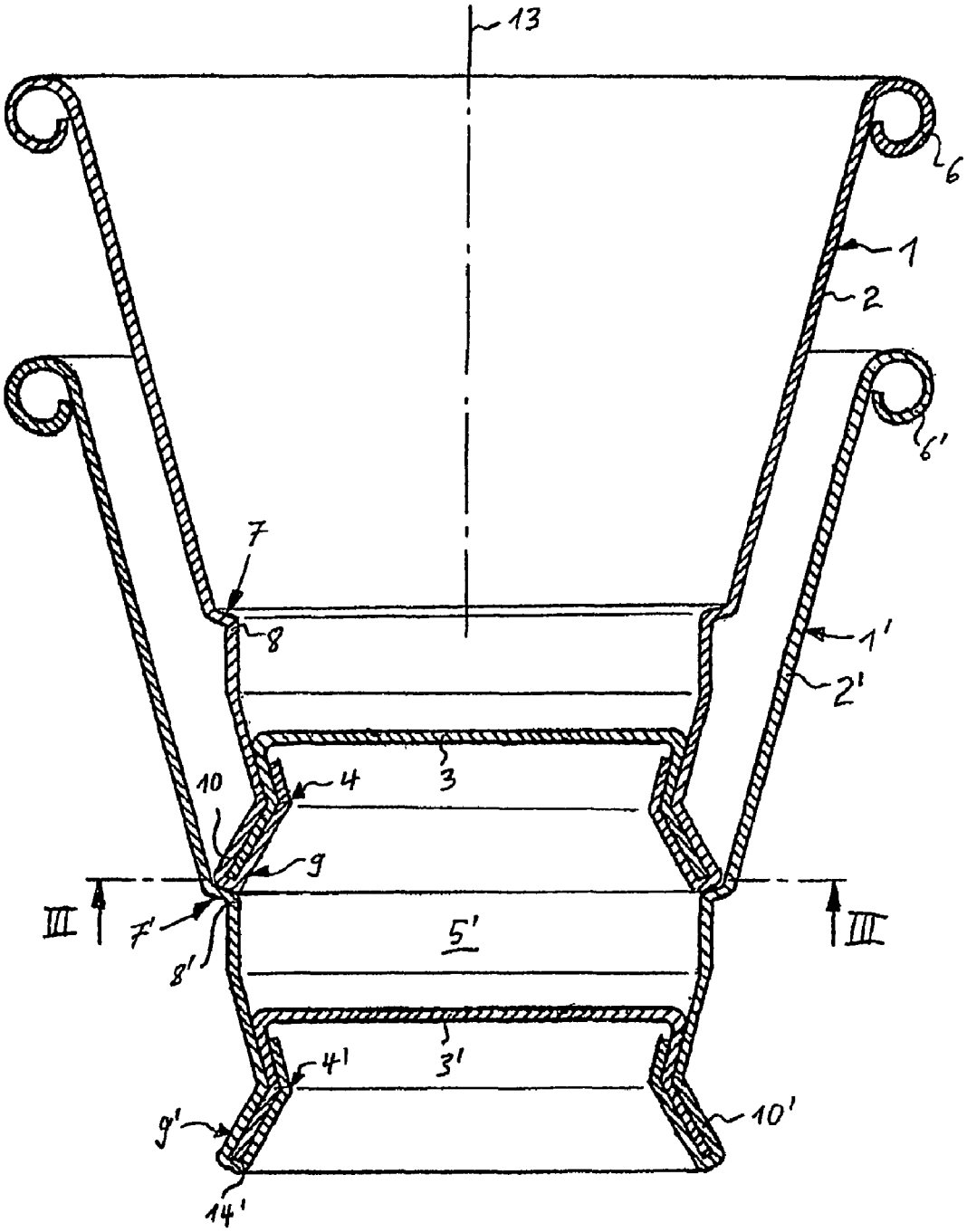
FIG. 2 shows a view similar to FIG. 1 of two stacked cups.

The outwardly projecting widening 10 also forms means 9 for holding another cup 1' of the same type, which means can act together with a similar cup 1' when the cup is stacked. The stacking of the cup 1 in a similar cup 1' is shown in FIG. 2. The widening 10, as a means 9 for stacking the cup 1, can hereby for example act together with a sleeve 2' defining the interior 5'. Further stacking means are not absolutely necessary.

The sleeve 2 defining the interior 5 advantageously comprises a first means 7 for holding another cup 1 of the same type, which means can be optionally formed. It is important that the first holding means 7 comprises a contour which can take up forces acting in the direction of the middle axis 13 of the cup 1, that is, forces which act between two cups during stacking. The first holding means 7 can be formed for example by means of a rib or a bead 8, which projects into the interior of the cup 1. The above mentioned second means 9 in the form of a widening 10 is arranged to the bottom skirt 4, at which the sleeve 2 defining the interior 5 is folded around the pot-shaped, deep drawn bottom 3 and fixed liquid-tight thereto.

The dimension Y of the second holding means 9 is adapted to the dimension X of the first means 7 for holding another cup 1' of the same type. In the case of a circular cross section of the cup 1, the dimension X of the first holding means 7 corresponds to the inner diameter of the sleeve 2 above the bead 8. The dimension Y of the second holding means 9 corresponds to the largest outer diameter of the widening 10 at the bottom skirt 4, that is, the diameter which the widening 10 encloses. The adaptation of the dimensions X and Y take place in that the dimension Y is somewhat smaller or at maximum is the same size as the dimension X.

The acting of the first means 7 and the second means 9 for holding is evident in the cups 1 and 1' shown in FIG. 2. The first means 7' of the cup 1' applied to the sleeve 2' defining the interior 5' takes up the second means 9 of the cup 1. The widening 10 applied to the bottom skirt 4 of the cup 1, and in particular the bottom end of the widening 10 is supported hereby on the bead 8', which is formed into the sleeve 2'. Because of the above mentioned adaptation of the dimension X of the first holding means 7 to the dimension Y of the second holding means 9, it is ensured that the widening 10 of the cup 1 stands on the bead 8' in a secure and stable way, without however wedging itself in the conical sleeve 2'. The forces which occur along the middle axis 13 during stacking, for example the forces of weight of the cup 1 or of the cups stacked on top of it, are taken up reliably by the bead 8' as the holding means 7' and relayed via the sleeve 2' to the lower edge 14' of the bottom skirt 4' of the lower cup 1', and passed on to the ground from the lower edge 14' located at the standing surface. This ensures the easy removability of the cup 1 or 1' when the cups are de-stacked, even when very high forces in the direction of the middle axis 13 occur.

In order not to impair the liquid tightness of the bottom skirt 4 when forming the widening 10, it is advantageous when the height B of the widening 10—as seen in FIG. 1—is smaller than the overall height Z of the bottom skirt 4. As a result of the low height B of the widening 10, a height area C remains on the bottom skirt 4, which provides the sealing between the sleeve 2 defining the interior 5 and the bottom 3. The height B corresponds preferably hereby to approximately half the height Z. The bottom skirt 4, as seen in axial section of FIG. 1, comprises different angles of inclination β and γ to the middle axis 13 of the cup 1. The angle of inclination p of the height area B of the bottom skirt 4 is hereby in any case so inclined that the bottom skirt 4 widens out towards the lower edge 14 and has the largest dimension Y at its lower edge 14, that is as seen parallel to the middle axis 13 the lower edge 14 of the bottom skirt 4 forms the area distanced furthest from the middle axis 13. In the case shown, the bottom skirt 4 still tapers in the height area C with the angle of inclination γ, which corresponds to the angle of inclination α of the sleeve 2 in the area of the interior 5. The widening 10 continues in any case up to the lower edge 14, which forms the standing surface. Further possible embodiments of the bottom skirt 4 are described below with the aid of FIG. 9.

The diameter Y surrounding the widening 10 is hereby advantageously larger than the diameter D, which surrounds the area of the bottom 3, which is in contact with the interior 5. In order to permit effective stacking, and that the stacking height is not unnecessarily high, it is advantageous when the holding means 7 assigned to the sleeve 2 defining the interior 5 is not arranged higher above the bottom 3 than a third of the height A of the interior 5. Even if the means 7 is omitted, and the widening 10 is supported directly on the conical area of the sleeve 2, the diameter Y enclosing the widening 10 is advantageously smaller than a diameter enclosing the inner contour of the sleeve 2 at a height above the bottom 3 of approximately a third of the height A.

A height area C, in which a part of the bottom skirt 4 remains in its original form without a widening, is in particular important for the process for producing a stackable cup 1 according to the present invention, in which process a semi-finished product having an already fillable interior 5 is used, which semi-finished product comprises a conical sleeve 2 and a bottom 3 already attached in a liquid-tight manner thereto. The semi-finished product comprises a bottom skirt 4, which does not yet comprise a widening 10. The bead 8 is formed as the first holding means 7 and the widening 10 as the second holding means 9 on the semi-finished product. This process has the advantage in that the semi-finished product can be produced on a standard cup-making machine. The semi-finished product is fed to an arrangement downstream of the standard cup-making machine, which arrangement forms the first holding means 7 and the second holding means 9 on the semi-finished product and completes the production of the stackable cup 1. The liquid tightness of the bottom skirt 4 is not impaired because of the height area C remaining unformed.

The rib or the bead 8 can be stamped or rolled by forming tools, which are placed to the sleeve 2 in axial or radial direction of the cup 1. The widening 10 at the bottom skirt 4 can for example be formed by a cone-shaped mandrel, which is placed to the bottom skirt 4 from below. If required, the bottom skirt 4 can be heated for the purposes of forming the widening 10. Because forming tools, which execute a sliding motion in relation to the surface of the bottom skirt 4, can very easily form creases, it can therefore also be advantageous to form the widening 10 by means of a rolling tool or by means of a tool which spreads out in radial direction. It can hereby be advantageous to assign to the outer circumference of the bottom skirt 4 a correspondingly formed counter tool, in order to support the formation of the widening 10.

Figure 3:
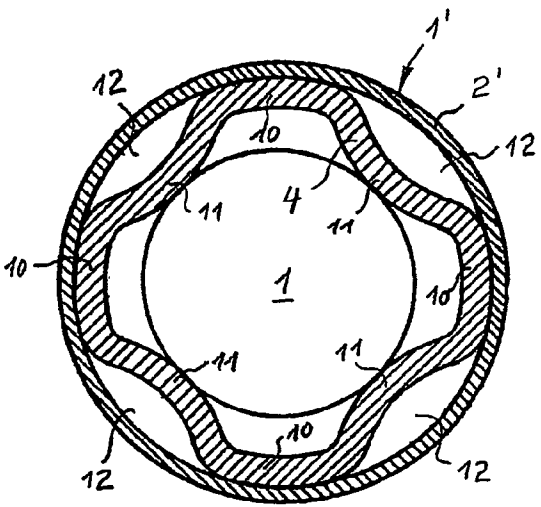
FIG. 3 shows an intersectional view along the intersectional surface III-III of a bottom skirt having a number of partial widenings.

FIG. 3 shows a particular embodiment of the widening 10 at the bottom skirt 4. The widening 10 according to FIG. 3 does not extend around the entire circumference of the bottom skirt 4. Instead, four widenings 10 are evenly distributed on the circumference, between each of said widenings 10 an area 11 without a widening is provided, which area 11 corresponds to the original contour of the bottom skirt 4. When the cup 1 is stacked in a similar cup 1', air passages 12, in conjunction with a bead 8 circulating the entire circumference, form between the sleeve 2' and the bead 8' of the cup 1' and the non-widened areas 11 of the cup 1, which could facilitate the de-stacking of the cups. When the cup 1 is removed from the cup 1', the air passages 12 permit air from the atmosphere to flow into the area of the interior 5' of the cup 1', located below the bottom 3 of the cup 1, so that a vacuum, which would act against the withdrawal motion of the cup 1, cannot form.

Figure 8:
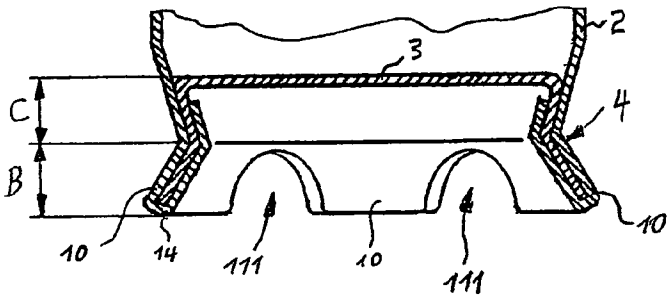
FIG. 8 is a longitudinal sectional view similar to FIG. 1 of a bottom skirt comprising a number of partial widenings and recesses lying therebetween.

In a further embodiment of the partial widening 10 of FIG. 3, the concave embodiment of the area 11 between the four widenings 10 can also be designed as linear or slightly convex. The outline of the bottom skirt 4 can be polygon in form, whereby the corners are, of course, rounded. Furthermore, as denoted in FIG. 8, it can be provided that the bottom skirt 4 comprises recesses 111, slits or predetermined breaking points in the areas 11 according to FIG. 3. In particular when the widening 10 is to project relatively far out, it can happen that the paper material of the sleeve 2 tears in an uncontrolled way at the lower edge 14. In order to prevent this uncontrolled tearing, recesses 111 or slits can be stamped into the paper material in the areas 11 between the widenings 10, as shown in FIG. 8, which recesses 111 or slits extend over the height area B of the bottom skirt 4, which height area B is not necessary for the tightness of the bottom skirt 4. Depending on the ductibility of the material at the bottom skirt 4, the height of the recesses 111 can be different, but do not however extend to any great degree above the height area B, so that a sufficiently large height area C remains for the purposes of sealing. The recesses 111 can either be provided in the blank of the sleeve 2, before the semi-finished product of sleeve 2 and bottom 3 is produced, or the recesses 111 can be just as well applied to the completed bottom skirt 4 before widening occurs.

Although not shown in FIGS. 1 to 3, it can be advantageous to assign the cup 1 a heat-insulating outer sleeve according to any of the FIGS. 4 to 7, which surrounds the sleeve 2 defining the interior 5 while forming a hollow space. In order that the stacking of the cup 1 is not impaired, it can be advantageous that the outer contour of the outer sleeve is located within a parallel 15 to the sleeve 2 defining the interior 5, whereby the parallel 15 is disposed on the widening 10 of the bottom skirt 4. As long as an outer sleeve is located within the space 16 between the parallel 15 and the sleeve 2 defining the interior 5, the stacking properties of the cup are not influenced in any way. The design possibilities are thus endless. It is also possible to equip a common embodiment of the cup 1 with variously designed outer sleeves, without having to change the first holding means 7 and the second holding means 9. Several possible embodiments for heat-insulating outer sleeves of this type are described below with the aid of FIGS. 4 to 7.

The cups 1 shown in FIGS. 4 to 7 each comprises a heat-insulating outer sleeve 417, 517, 617 and 717, which surrounds the sleeve 2 defining the interior 5 partly under formation of a hollow space 18. Cups of this type are defined as double-walled insulating cups, in which the sleeve 2, in conjunction with the bottom 3, located inside of the outer sleeve 417, 517, 617 and 717 can be defined as an "inner cup". The first means 7 for holding another cup 1' of the same type and the second holding means 9 are designed analogue to the embodiment described in FIG. 1, so that a repeat description is hereby omitted.

In the production of a double-walled cup 1 according to FIGS. 4 to 7, a first holding means 7 is formed on an inner cup fed in the form of a semi-finished product, which can already comprise a lip 6. The outer sleeve 417, 517, 617 and 717 is subsequently slid on and fixed to the sleeve 2 defining the interior 5. In a last procedural step, the second holding means 9 is formed. This has the advantage in that the second holding means 9 does not impair the sliding on of the outer sleeve 416, 517, 617, 717, and that for example the dimension Y of the widening 10 can be larger than the inner contour of the outer sleeve 417, 517, 617, 717.

Figure 4:
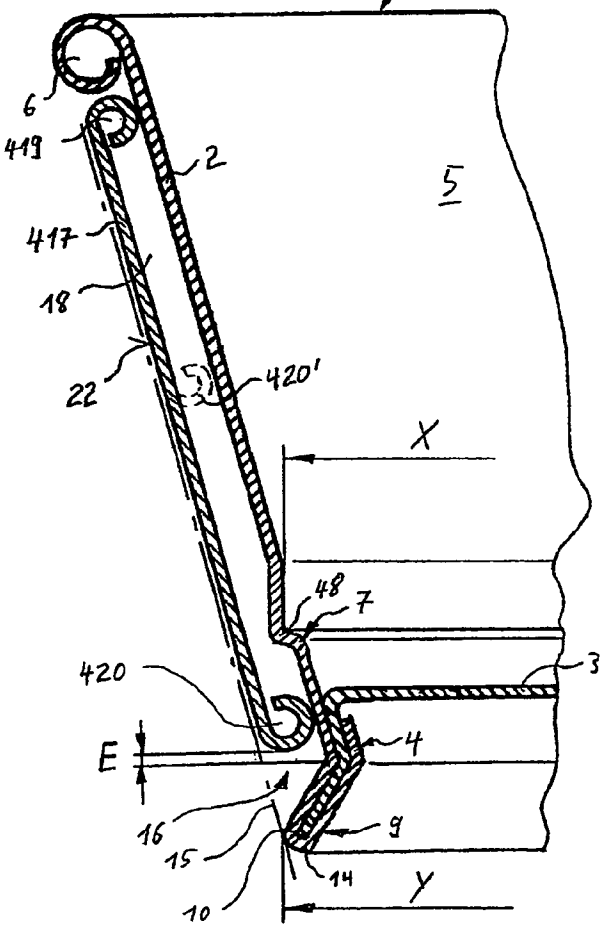
FIGS. 4 to 7 show views similar to FIG. 1 of partly shown cups of various designs, in which different outer sleeves are provided.

The outer sleeve 417 of the cup 1 shown in FIG. 4 is arranged essentially parallel to the sleeve 2 defining the interior 5. The outer sleeve 417 comprises on an upper and on a lower end inwardly rolled curled parts 419 and 420 and is supported by the curled parts 419 and 420 on the sleeve 2 defining the interior 5. It can be provided that the outer sleeve 417 is fixed in the area of the curled part 419 and/or 420, for example by means of gluing. The height of the outer sleeve 417 can vary as required, as shown by the curled part 420' denoted by a broken line. Particularly advantageous is a height of the outer sleeve 417, which corresponds to the shown curled part 420, whereby the outer sleeve 417 ends above the widening of the bottom skirt 4 and below the bottom 3. The distance E between the outer sleeve 417 and the widening 10 measures advantageously approximately 1 to 2 mm. The height of the outer sleeve 417 in this case ensures accessibility to the bottom skirt 4 from the outside even when the outer sleeve 417 is already slid on, so that the forming of the widening 10 with a tool radially placed from outside is not hindered by the outer sleeve 417. The curled part 420 is supported in the area of the bottom skirt 4 on the inner sleeve 5, as a result of which the outer sleeve 417 is very stable. At the same time the outer sleeve 417 also covers the first holding means 7, so that this is not recognizable from the outside. The bead 48 is, in contrast to FIG. 1, formed outwards. The take-up properties of the holding means 7 can hereby be increased, as the stretched paper material of the bead 48 has a higher stability than the compressed paper material of the bead 8 in FIG. 1.

Figure 5:
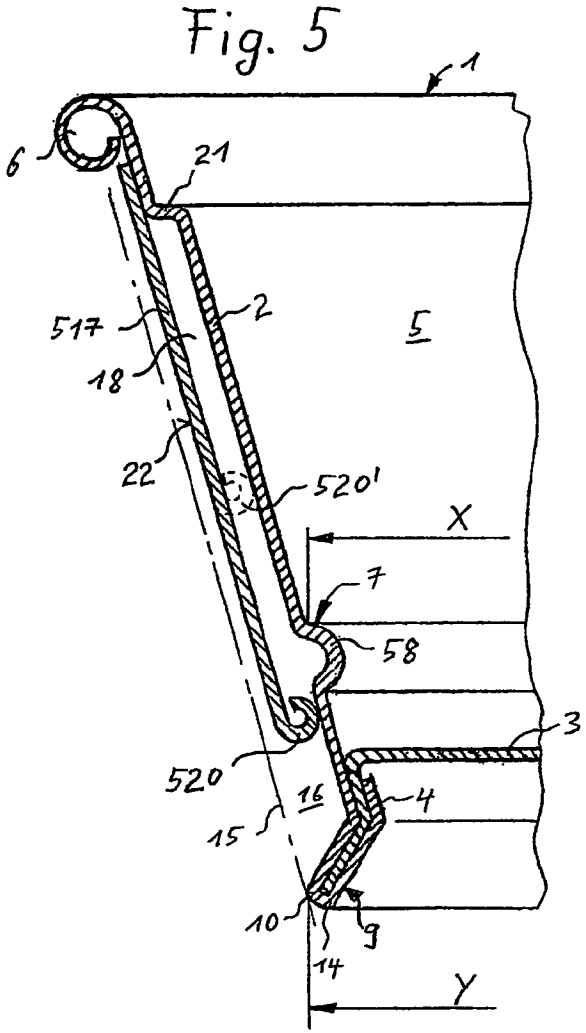

In FIG. 5, the sleeve 2 defining the interior 5 comprises an abrupt change in size in the form of a shoulder 21 in the area below the lip 6, which shoulder 21 presents itself as an abrupt increase of the cross section when seen from the bottom 3 to the lip 6. The outer sleeve 517 is attached in the area between the lip 6 and the shoulder 21 to the sleeve 2 defining the interior 5, for example by means of sealing or gluing. At its lower end the outer sleeve 517 comprises an inwardly rolled curled part 520 analogue to the curled part 420, which can, in turn lie alternatively also upwards in the position 520' as shown by the broken line. An outer sleeve 517 which ends above the bottom 3 often achieves a sufficient insulation effect and has the advantage in that the material requirements for the outer sleeve 517 are reduced. The height position of the curled part 520 can alternatively also be chosen according to the criteria as described in FIG. 4 and be disposed in a lower position. The holding means 7 is designed as a rounded rib 58, whereby the rib 58 need not be stamped out all the way around the circumference, but rather very advantageously can consist of only selected stamped areas in the sleeve 2.

Figure 5A:
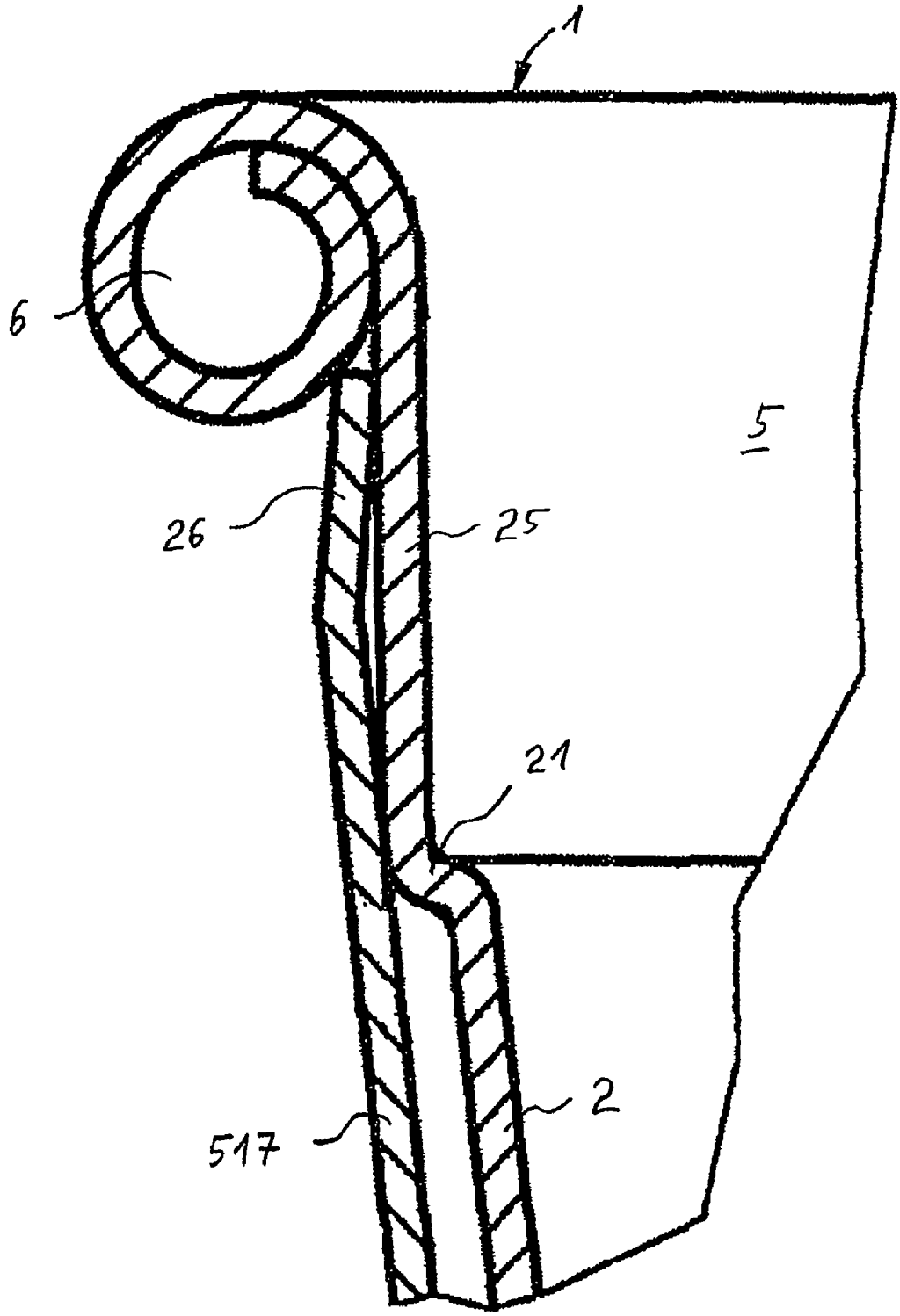

In contrast to the depiction shown in FIG. 5, the cup 1 can be designed differently in the area of the shoulder 21. An advantageous variation in the area of the shoulder 21 is shown greatly enlarged in FIG. 5A. The area of the sleeve 2 defining the interior 5, which lies between the lip 6 and the shoulder 21 and which is denoted by the reference number 25, comprises, in contrast to the depiction shown in FIG. 5, another angle of inclination to the middle axis 13 than the rest of the sleeve 2. In FIG. 5A, the area 25 of the sleeve 2 extends between lip 6 and the shoulder 21 approximately parallel to the middle axis 13. In order that the outer sleeve 517 can be placed to a small degree underneath the lip 6 when the outer sleeve 517 is slid onto the inner cup 1, the upper edge area 26 of the outer sleeve 517 is slightly compressed. The edge area 26 does not uniformly extend the conical outer sleeve 517, but rather comprises a somewhat tapering diameter. If the outer sleeve 517, as shown in FIG. 5A, is pushed slightly with its upper edge into the lip 6, the cup 1 obtains particularly good outward appearance, as the upper edge of the outer sleeve 517 is no longer visible. If the outer sleeve 517 is pushed further into the lip 6 in an embodiment not shown, the wedging of the outer sleeve 517 effects a fixing of the outer sleeve 517 by means of the material of the lip 6. For certain applications, the wedging of the outer sleeve 517 in the lip 6 can be sufficient to provide the only attachment of the outer sleeve 517.

Figure 6:
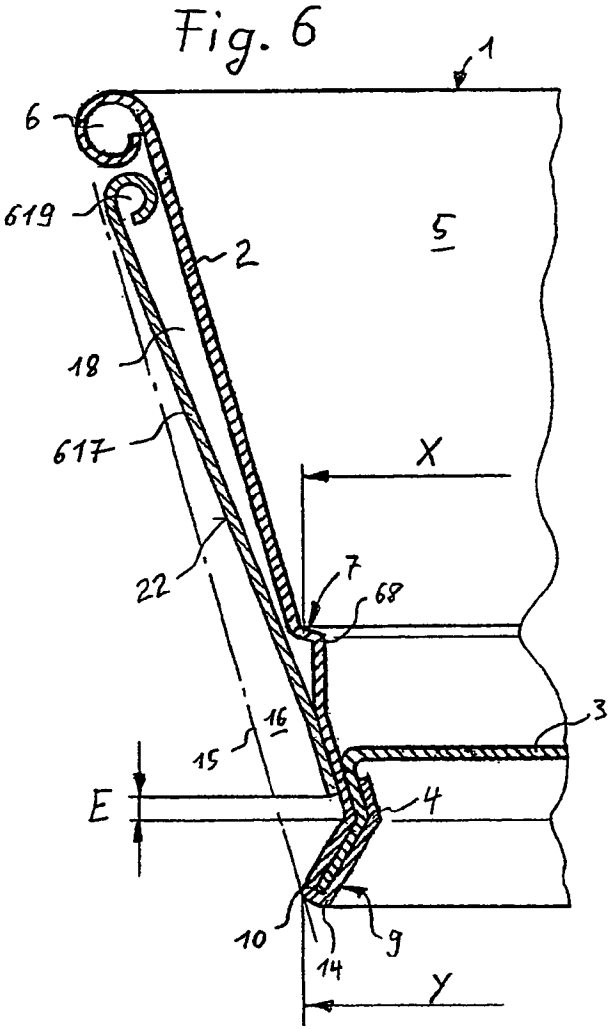
Figure 6A:
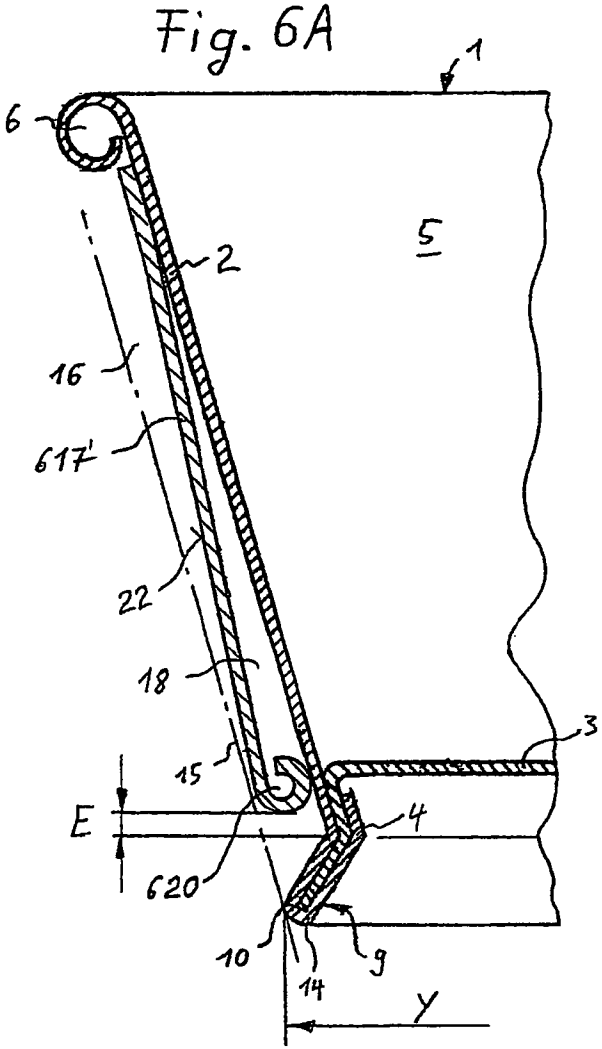

FIG. 6 shows a variation of an outer sleeve 617, in which the hollow space 18 has its greatest thickness in the upper area and tapers increasingly downwards. At the upper end of the outer sleeve 617 an inwardly rolled curled part 619 is provided, which can be supported on the sleeve 2 defining the interior 5. The outer sleeve 617 can also end above the bottom skirt 4, or as shown, above the widening 10 at a distance E and can, for example, be sealed there in this area in a flattened position. FIG. 6A shows an alternative, in which the outer sleeve 617 also does not extend parallel to the sleeve 2. The outer sleeve 617' is sealed in a flattened position below the lip 6 and the thickness of the hollow space 18 increases in size in the downward direction. The outer sleeve 617' is supported at the lower end with a curled part 620 analogue to the curled part 420 on the sleeve 2. The cup 1 in FIG. 6A does not comprise a bead 68. During stacking, the widening 10, without any further means for stacking, acts with another cup 1' of the same type and is supported directly on the sleeve 2 defining the interior 5.

Figure 7:
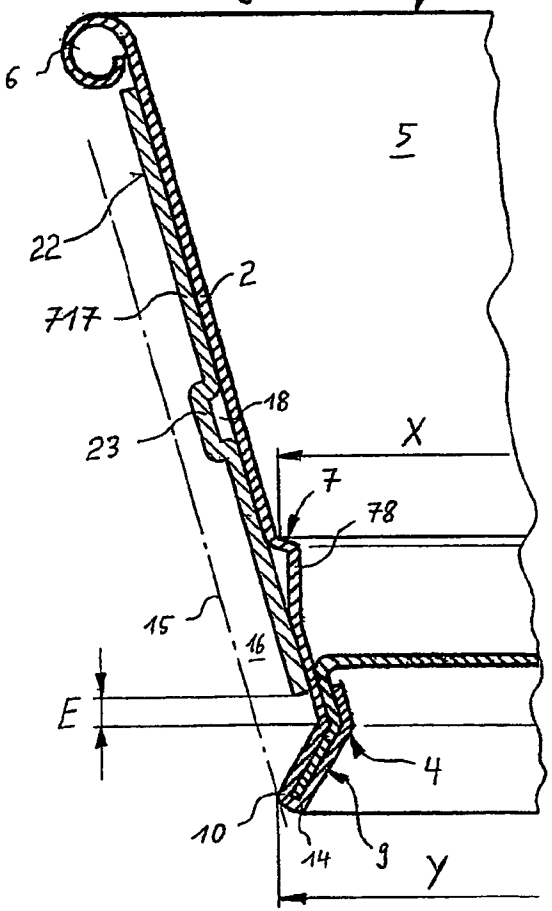

An outer sleeve 717 is shown in FIG. 7, which encloses tightly the sleeve 2 defining the interior 5 and essentially sits closely over the entire surface. An outer sleeve 717 of this type can be sufficient when the requirements of the insulation effect of the cup 1 are not particularly demanding. In addition, a closely sitting outer sleeve 717 can improve the stability of the cup 1, as the sleeve 2 is practically supported over its entire height on the outer sleeve 717. The fixing of the outer sleeve 717 takes place advantageously in turn by means of sealing or gluing, whereby the fixing can take place in selected areas or also over the entire surface. In an embodiment of the outer sleeve 717, outwardly embossed areas 23 are provided in the outer sleeve 717. The embossed areas 23 can be design elements in the cup 1, for example, writing which denotes the product contained inside. The embossed area 23 can also be used, however, in order to specifically increase the insulating effect of the outer sleeve 717 in certain areas, as beneath the embossed areas 23, hollow spaces 18 occur. The embossed areas 23 can for example be arranged in the areas of the cup 1 which come into contact with the hand holding the cup.

Even when the bead 48, 58 of the first holding means 7 in the cups shown in FIGS. 4 and 5 have a somewhat different design to the other Figures, the dimension Y of the second holding means 9 is nevertheless adapted to the dimension X of the first means 7 for holding another cup 1' of the same type. When the dimensions X and Y in the cases of the cups 1 of FIGS. 4 to 7 having the varying outer sleeves 417, 517, 617 and 717 are identical, then all these cups 1 can be stacked optionally in combination with one another without wedging, as all the outer sleeves 417, 517, 617 and 717 lie within the space 16 between the parallel 15 and the sleeve 2 defining the interior 5. In order to vary the optical and haptical appearance of the cup 1, the outer side 22 of the outer sleeve 417, 517, 617 and 717 can have varying structures. The outer side 22 can for example be corrugated, fluted, embossed or comprise a foamed coating. It can also be provided that the outer sleeves 417, 517 and 617 have a fluted design, and also to provide additionally the outer side 22 with a smooth cover of the fluted structure in the form of a further sleeve, in order to improve the insulating properties of the cup 1.

In particular the embodiment of the outer sleeve 417 comprising an upper curled part 419 or the fixing of the outer sleeve 517 in the area of the shoulder 21 of the sleeve 2 have the advantage in that in an area closely below the lip 6, already a very wide hollow space 18 occurs between the sleeve 2 and the outer sleeve 417, 517, which provides a very high insulating effect. The curled part 419 or the shoulder 21 ensure, even without additional means, for example foam coatings or corrugated paperboard layers within the hollow space 18, that the distance between the sleeve 2 and the outer sleeve 417 or 517 does not decrease even under pressure, for example from a hand gripping the cup 1, and that the insulation effect is not lost.

It should be expressly pointed out here that the various embodiments of the outer sleeve 417, 517, 617 and 717, and other design elements means of the cup 1 such as the bead 8, 48, 58, 68, 78 or the shoulder 21 can, as required, be combined with one another, and are not limited to the variations shown here.

Figure 9:
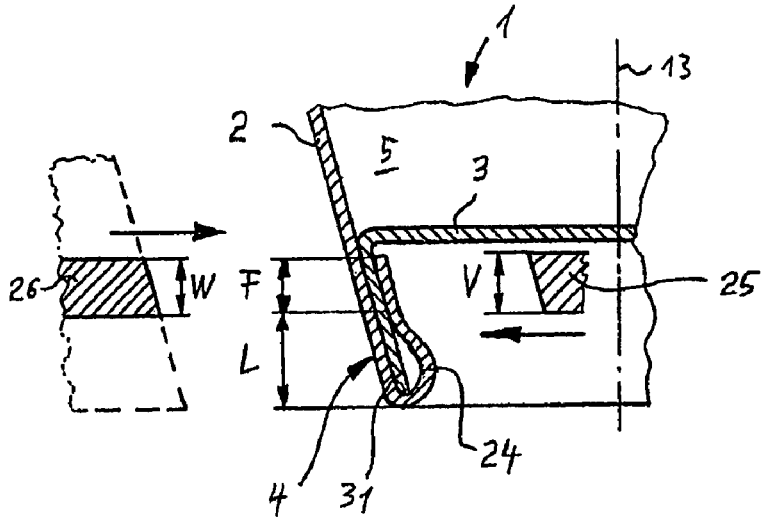
FIG. 9 shows a longitudinal sectional view of the bottom skirt of a cup according to the present invention with an inner tool and an outer tool for pressing the bottom skirt.
Figure 10:
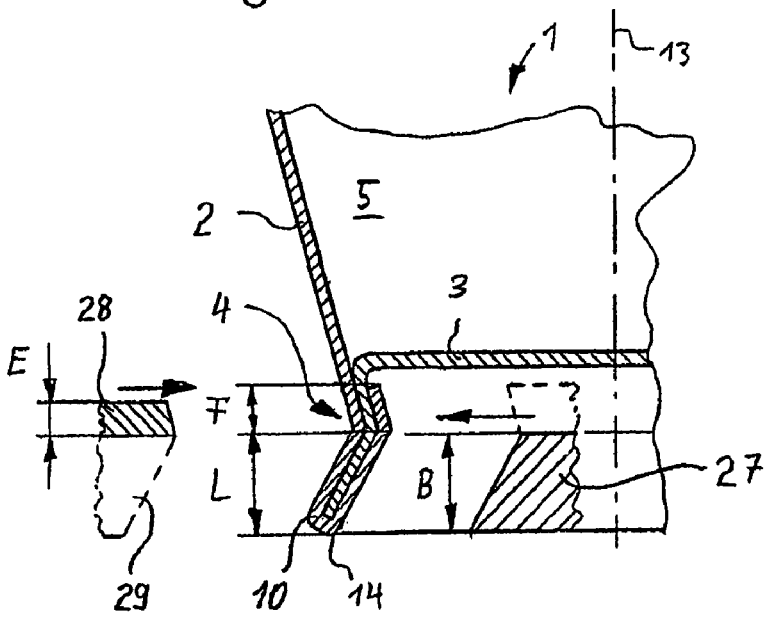
FIG. 10 is a section view of a cup in the area of the bottom skirt during the application of the widening with a widening tool and a supporting tool.

With the aid of FIGS. 9 and 10 the process and the arrangement for producing a cup 1, as for example shown in FIGS. 1 to 8, are described in more detail. The bottom skirt 4 of the cup 1 shown in FIG. 8 comprises two height areas F and L. In the height area F, which is referred to as the fixed area F of the bottom skirt 4, the wall 31 of the pot-shaped bottom 3 is attached liquid-tight to the sleeve 2. In the height area L, referred to as the non-attached area L of the bottom skirt 4, the wall 31 of the pot-shaped bottom is not attached to the sleeve 2. The sleeve 2 can, as shown, hereby be placed loosely around the wall 31 of the bottom 3 and form a type of bulge 24. Alternatively the sleeve 2 can be folded over the wall 31 without a bulge 24. Even when the material coatings of the sleeve 2 and the bottom 3 lie closely together in the non-attached area, it is important that the material layers are not fixed to one another.

The production of the cup 1 takes place in that, in the known way, a flat-lying blank for the sleeve 2 is wrapped on a mandrel around the middle axis 13 and joined together in an overlapping area parallel to the middle axis 13, so that the sleeve 2 is formed. A pot-shape, pre-formed bottom 3 with a wall 31 is slid parallel to the middle axis 13 into the conical sleeve 2. The sleeve 2 is then folded inwards around the wall 31.

The paper material of the sleeve 2 and the bottom 3 advantageously comprise on their sides facing the interior 5 a coating of thermoplastic synthetic material. The joining of the sleeve 2 with the bottom 3 can hereby take place by means of heat sealing, in which the sleeve 2 and/or the bottom 3 is at least warmed up in the area which subsequently forms the fixed area F, so that the coating melts. Warming up occurs advantageously by means of blowing hot air onto the sleeve 2 and/or the bottom 3, advantageously before the bottom 3 is inserted into the sleeve 2. Alternatively it can be provided that at least in the area subsequently forming the fixed area F and/or the wall 31, glue is applied before the bottom 3 is inserted into the sleeve 2.

In order to join the sleeve 2 with the bottom 3, the wall 31 is pressed to the sleeve 2 in the fixed area F. The production machine comprises for this purpose an inner tool 25 shown schematically and an outer tool 26, also shown schematically, which can be placed to the bottom skirt 4 for example in the direction of the shown arrows and which press the sleeve 2 and the wall 31 to one another with a pressing force. The form of the bottom skirt 4 shown in FIG. 9 occurs when the inner tool 25 and the outer tool 26 are moved apart again from one another opposite to the direction of the shown arrows subsequent to pressing the sleeve 2 and the bottom 3 together. The inner tool 25 comprises a height V in the area which comes into contact with the bottom skirt 4. The outer tool 26 comprises a height W in the area which comes into contact with the bottom skirt 4. In the shown case, the height V and W of the inner tool 25 and the outer tool 26 each correspond to the height of the fixed area F. It can also be alternatively provided that only the inner tool 25 or the outer tool 26 has a height which measures less than the height Z of the bottom skirt 4. In FIG. 9 an outer tool 26 having a height W exceeding the height of the bottom skirt is denoted by a broken line. An outer tool 26 having a height W of this dimension has the advantage in that the sleeve 2 is more extensively supported.

The inner tool 25 and the outer tool 26 can be designed differently and are already known in a number of variations. The inner tool 25 can be formed for example by a mandrel comprising jaws movable in radial direction, or by a press roller rotating in circumferential direction of the bottom skirt 4. The outer tool 26 can also comprise radially movable jaws or a roller rotating in circumferential direction. In an advantageous alternative, a ring-shaped outer tool 26 can be used, which, in contrast to FIG. 9, is slid parallel to the middle axis 13 onto the bottom skirt 4 from below and which surrounds, ring-shaped, the entire area of the sleeve 2.

The cup 1 shown in FIG. 9 with a widening on the bottom skirt 4 is advantageously a semi-finished product for a cup according to FIGS. 1 to 8. It can also be advantageous to optionally form the non-attached area L in another way, or to leave it in this form and to use the cup 1 directly in this form.

An arrangement for widening the bottom skirt 4 is shown schematically in FIG. 10. A widening tool 27 is provided, which can be placed to the bottom skirt 4 in the non-attached area L. Depending on the embodiment of the widening tool 27 as radially movable jaws, or as a roller rotating in circumferential direction of the bottom skirt, or as a conical mandrel, the feed motion occurs in radial direction of the shown arrow, or alternatively also axially, that is parallel to the middle axis 13 from the open end of the pot-shaped bottom 3. The area of the widening tool 27 forming the widening 10 advantageously comprises the height B of the widening 10 to be formed. If the widening tool 27 is placed to the bottom skirt 4 and the widening 10 is formed, the material layers of the sleeve 2 and the bottom 3 can slide against one another, as they are not attached to one another in the non-attached area L. Irregularities and tolerances can hereby be balanced out, so that the risk of tearing, in particular in the outer layer of the sleeve 2, is reduced. The height L advantageously corresponds to the height B. Depending on the expansion properties of the paper material and on the stability requirements of the bottom skirt 4, it can also be advantageous to chose the height L larger or advantageously smaller than the height B. The material contained in a bulge 24 can spread to a small extent during the forming of the widening 10 and thus further reduce the risk of tearing.

In order that the fixed area F of the bottom skirt 4, which advantageously corresponds essentially to the height area C, is not itself widened during the widening process, a supporting tool 28 can be placed to the fixed area F of the bottom skirt 4. The height of the supporting tool 28 is adapted advantageously to the distance E between the widening 10 and an outer sleeve 417, 717 (not shown in FIG. 10). The supporting tool 28 can be designed for example as a rotating roller, which rotates synchronously with the widening tool 27 in the form of a roller along the periphery of the bottom skirt 4. It can also be provided that the supporting tool 28 is designed as a ring consisting of a number of segments, which can be moved apart in radial direction after the widening process, so that the cup with the widening can be removed from the supporting tool 28. In order to improve the fixing and support of the fixed area F during the widening of the lower edge 14 of the bottom skirt 4, the widening tool 27 can be designed larger as demonstrated by the broken line.

It can also be advantageous to lengthen the supporting tool 28 downwards, as demonstrated by the broken line, so that it comprises an area 29, which surrounds the widening 10 from the outside. The area 29 of the supporting tool 28 can act together with the widening tool 27 and press the bottom skirt 4 in the area of the widening 10. It is as a result still possible to attach the wall 31 of the bottom 3 to the sleeve 2 subsequent to the widening process. This can take place, for example again under the action of heat, in that for example the widening tool 27 and/or the supporting tool 28 is heatable.

In the device for producing the cup 1, a number of working stations are provided, through which the cup 1 travels during its production. The widening tool 27 and the supporting tool 28 are advantageously arranged in a working station, which is arranged downstream of a working station in which the inner tool 25 and the outer tool 26 are arranged.

In the individual embodiments A to E in FIG. 11, various designs of the cup 1 in the area of the widening skirt 4 are shown in schematic form. In the variations of the FIGS. 1 to 10, the bottom skirt 4 is always formed by three layers of material, namely from two material layers of the sleeve 2, which surround the wall 31 of the pot-shaped bottom 3 on the inside and on the outside. This embodiment is often very advantageous, but is not absolutely necessary for the realization of the present invention. The following variations described below can be advantageous for certain requirements.

Figure 11A:
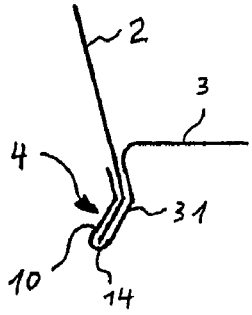
FIG. 11A to E show schematic and only partly longitudinal sectional views of various embodiments in the area of the bottom skirt of cups according to the present invention.

In FIG. 11A it is provided that the material of the bottom 3 is folded outwards and surrounds the material of the sleeve 2. The lower edge 14 of the widening 10, which forms the standing surface for the cup 1, is hereby formed by the material of the bottom 3.

Figure 11B:
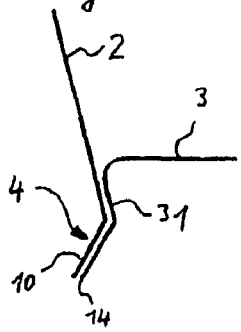
Figure 11C:
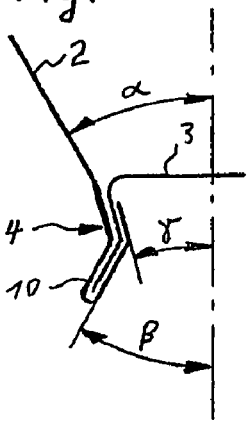
Figure 11D:
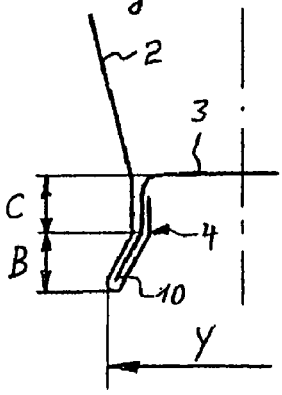
Figure 11E:
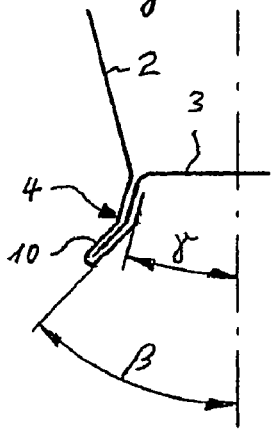

An embodiment is shown in FIG. 11B, in which the bottom skirt 4 is only formed by two material layers. The material of the sleeve 2 and the wall 31 of the bottom 3 both end at the lower edge 14 and form hereby the standing surface. It is also provided in this case that the widening 10 is formed in a non-attached area L of the bottom skirt 4, in which the wall 31 of the pot-shaped bottom 3 is not attached to the sleeve 2. In the FIGS. 11C, 11D, 11E embodiments of the bottom skirt 4 of the cup 1 are shown in which the bottom skirt 4 has varying angles of inclination to the middle axis 13, in particular in the height area C, in which the fixed area F is located. In the FIGS. 1 to 10, the angle of inclination $\gamma$ corresponds approximately to the angle of inclination $\alpha$ of the sleeve 2 in the area of the fillable interior 5. This embodiment is very simple to produce, as the semi-finished product has the same angle of inclination $\alpha$ over the entire height before the widening 10 is applied. Depending on the height Z of the bottom skirt 4 and the desired size of the widening 10, it can, however, be necessary to use a semi-finished product in which the angle of inclination $\gamma$ of the bottom skirt 4 deviates from the angle of inclination $\alpha$, in order to prevent the paper material tearing at the lower edge 14 during the widening process of the bottom skirt 4. It can hereby be sufficient, during pressing of the bottom skirt 4 by the inner tool 25 and the outer tool 26, to chose the angle of inclination $\gamma$ to be somewhat smaller than the angle of inclination $\alpha$, as shown in FIG. 11C. The angle of inclination $\gamma$ is advantageously reduced that it measures approximately 0°, so that the bottom skirt 4 in the height area C and thus also in the fixed area F extends approximately parallel to the middle axis 31, as shown in FIG. 11D. When widening to the same degree, larger dimensions Y of the widening 10 can be hereby achieved. This effect can be increased when the bottom skirt 4 is widened already in the fixed area F with an angle of inclination $\gamma$, as shown in FIG. 11E. In the variation according to FIG. 11E, the angle of inclination $\beta$ is advantageously larger than the angle of inclination $\gamma$.

Figure 12:
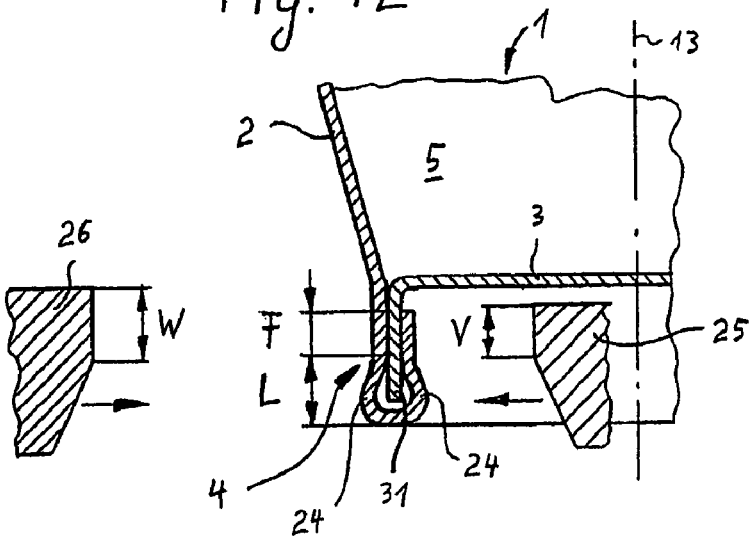
FIG. 12 is a view similar to FIG. 9 of a further variation.

In FIG. 12 another embodiment of the cup 1 in the area of the bottom skirt 4 is shown. The depiction is similar to the one in FIG. 9. The form of the bottom skirt 4 of the cup 1 shown in FIG. 12 is so chosen that the cup 1 is can be applied very advantageously as a semi-finished product for the cup shown in FIG. 11D. The bottom skirt 4 extends in the fixed area F approximately parallel to the middle axis 31 and is as a result essentially cylindrical in this area. The inner tool 25 and the outer tool 26 for pressing the sleeve 2 to the wall 31 of the bottom 3 are designed in such a way that it can only apply a pressing force to the bottom skirt 4 in the fixed area F. In the shown case, the height V of the area of the inner tool 25 which comes into contact with the bottom skirt 4 corresponds approximately to the height of the fixed area F. In the non-attached area L of the bottom skirt 4, a bulge 24 is provided on the inside and the outside of the bottom skirt 4, which can constitute a material reserve for a widening 10 to be formed at a later stage. Depending on the type of paper material used, one or both of the bulges 24 can, in certain circumstances, be dispensed with, so that the sleeve 2 and the bottom 3 lie in a non-fixed way on top of one another in the non-attached area F.

The invention claimed is:

1. A cup made of paper material and having a fillable interior, said cup being formed by a conical sleeve and a bottom member defining a bottom wall positioned at the lower end of the interior, the bottom member having a bottom skirt attached to the sleeve in a liquid-tight manner, wherein the bottom skirt has a first area which overlaps the sleeve and is circumferentially fixedly attached to the sleeve in said liquid-tight manner, wherein the bottom skirt has a second area which overlaps the sleeve, said second area and said sleeve being non-attached to one another to prevent creation of a liquid-tight engagement therebetween, and wherein said second area of said bottom skirt includes an outwardly projecting widening in a region along a lower periphery thereof, said widening being angled relative to said first area.

2. A cup according to claim 1, wherein said first area is defined by a first annular part of said bottom skirt disposed in surrounding liquid-tight engagement with an annular part of said sleeve at an elevation adjacent said bottom wall, and wherein said second area is defined by a lower part of said bottom skirt which depends downwardly from said first area and is located below said bottom wall and is disposed in surrounding relationship with a lower part of said sleeve, said second area being free to slide relative to the lower part of said sleeve when the lower part of the bottom skirt is deformed outwardly to define said widening.

3. A cup according to claim 2, wherein a plurality of said widenings are formed in said second area and are disposed in annularly spaced relationship along a lower periphery of said bottom skirt.

4. A cup according to claim 1, including a heat-insulating outer sleeve member disposed in exterior surrounding relationship to said sleeve and extending lengthwise of the cup from a location adjacent a top thereof to a location adjacent said bottom wall.

5. A cup according to claim 1, wherein a plurality of said widenings are formed in said second area and are disposed in annularly spaced relationship along a lower periphery of said bottom skirt.

6. A cup according to claim 1, wherein said first area defines the sole sealing engagement between said sleeve and said bottom member.

7. A cup according to claim 1, wherein the lower periphery of the bottom skirt defines a lower peripheral edge of said bottom skirt, including the widening formed therein, and the lower peripheral edge defines a support surface for the cup when supported in upright relationship on a surface.

8. A cup according to claim 1, wherein first and second said cups can be vertically stacked one within the other, and wherein a lower peripheral edge on said first cup, when vertically stacked above and within said second cup, is engaged with and supported on a surface defined within the interior of said second cup.

9. A cup according to claim 1, wherein said bottom member has an inverted pot-shaped configuration defined by said bottom wall and said bottom skirt, and said second area is located on said bottom skirt adjacent the lower periphery thereof.

10. A cup according to claim 1, wherein said first area has a generally conical configuration which converges as it projects downwardly, and wherein the second area is located below said first area and diverges as it projects downwardly and terminates at said lower periphery.

11. A cup made of a paper material and defining a fillable interior opening downwardly from a top end thereof, the cup including (1) a vertically elongate tapered sleeve member of paper material which functions as an upright side wall for said fillable interior, and (2) an inverted pot-shaped bottom member of paper material closing off the sleeve member adjacent a lower end thereof and defining a bottom wall which functions as a bottom of said fillable interior, said bottom member having a bottom skirt which surrounds and depends downwardly from said bottom wall and cooperates with a lower part of said sleeve member which projects downwardly below said bottom wall, the lower part of said sleeve member and the bottom skirt having overlapping annular parts positioned generally adjacent and around said bottom wall, said overlapping annular parts defining upper overlapping annular areas maintained in liquid-tight engagement with one another, said overlapping annular parts also having lower overlapping areas which are not attached to one another in a liquid-tight manner to permit relative sliding therebetween, and said overlapping annular parts in said non-attached lower overlapping areas having at least one radially outwardly projecting deformed region defining a widening in an area along a lower peripheral edge of said cup, said widening being angled relative to said upper overlapping annular areas.

12. A cup according to claim 11, wherein a plurality of said widenings are formed in the lower peripheral edge of said cup in angularly spaced relationship therearound.

13. A cup according to claim 11, wherein the lower overlapping areas are initially formed with slits or recesses opening upwardly from a lower peripheral edge thereof to facilitate outward deforming thereof to create said widening.

14. A cup according to claim 11, including an outer heat-insulating sleeve disposed in exterior surrounding relationship to said sleeve member and extending lengthwise of said cup from a location adjacent said top end to a location adjacent said bottom wall.

15. A cup according to claim 11, wherein the upper overlapping annular areas taper radially inwardly as they project downwardly from said bottom wall and define the liquid-tight engagement therebetween, and wherein the lower overlapping areas which are not attached in a liquid-tight manner are deformed to taper generally outwardly as they project downwardly to define said widening and define the lower peripheral edge of said cup.

* * * * *